US005835626A

United States Patent [19]

Huber et al.

[11] Patent Number: 5,835,626

[45] Date of Patent: Nov. 10, 1998

[54] METHOD FOR ADJUSTING THE INKING IN A PRINTING PRESS

[75] Inventors: Werner Huber, Rauenberg; Harald Bucher, Eschelbronn; Wolfgang Geissler, Bad Schönborn; Bernd Kistler, Eppingen, all of Germany

[73] Assignee: Heidelberger Druckmaschinen AG, Heidelberg, Germany

[21] Appl. No.: 643,600

[22] Filed: May 6, 1996

[30] Foreign Application Priority Data

May 4, 1995 [DE] Germany ..... 195 16 330.3

[51] Int. Cl.[6] ..... B41F 31/02

[52] U.S. Cl. ..... 382/167; 101/365; 101/484; 395/109

[58] Field of Search ..... 358/504, 518, 358/523; 382/167, 236, 239; 395/109, 527; 364/526; 101/365, 484; 356/402; 348/401, 394

[56] References Cited

U.S. PATENT DOCUMENTS

| | | | |
|---|---|---|---|
| 4,649,502 | 3/1987 | Keller et al. | 364/519 |
| 4,852,485 | 8/1989 | Brunner | 101/211 |
| 5,029,527 | 7/1991 | Jeschke et al. | 101/365 |
| 5,167,010 | 11/1992 | Elm et al. | 395/50 |

FOREIGN PATENT DOCUMENTS

| | | |
|---|---|---|
| 0 196 431 B1 | 10/1986 | European Pat. Off. . |
| 32 26 144 A1 | 2/1983 | Germany . |

OTHER PUBLICATIONS

Arun N. Netrauali and Barry G. Haskell "Digital Pictures, Representation, Compression, and Standards", second edition, 1995, p. 11, Plemum Press, New York and London.

*Primary Examiner*—Leo Boudreau
*Assistant Examiner*—Dmitry A. Novik
*Attorney, Agent, or Firm*—Herbert L. Lerner; Laurence A. Greenberg

[57] ABSTRACT

A method for controlling inking during the printing process, in particular during the production run, in a printing press, the printing press having an imaging device coupled to a computing device operative for collecting image color measurement data from the imaging device, and numerically processing the image data, and in which color measurement data are obtained from printed images produced on an continuous basis, these data being used for control or regulation to influence image inking if a predetermined image color tolerance is exceeded, the method which comprises the steps of collecting the image color measurement data, over time using the image color measurement data for computing a color trend estimate; evaluating the color trend estimate and performing a corrective control of the inking if the color trend estimate data indicate that image coloring will move outside the allowable image color tolerance.

3 Claims, 2 Drawing Sheets

METHOD FOR ADJUSTING THE INKING IN A PRINTING PRESS

BACKGROUND OF THE INVENTION

FIELD OF THE INVENTION

The invention relates to a method for controlling or regulating inking during a printing process, in particular during a production run of a printing press, in which color measurement data are obtained from the printed images produced on an ongoing basis and these data are used for the control or regulation process to influence inking if a predetermined color tolerance is exceeded.

A method of the type described above is known from European Patent Disclosure 0 196 431. In this known method, variables ascertained by setting ink layer thicknesses and/or matrix dot sizes of various printing inks or colors into relation with one another are used for regulating the desired color balance. If these variables fall outside tolerance ranges associated with them, then a corrective intervention in the printing operation is made.

The invention also relates to attaining a uniform printing result. Its object is to create a method for adjusting inking that can be done quickly and simply.

SUMMARY OF THE INVENTION

According to the invention, this object is attained in that the development over time of the color measurement data is used for a trend estimate; that the trend estimate is weighted; and that a corrective control or regulation of the coloration and/or the inking is performed if certain trend estimate data are outside the tolerance. According to the invention, from already available information, namely the color measurement data of the continuously produced printed images, the data being picked up by means of an optical detection device or the like, the future development or trend is thus estimated. Hence a preventive possibility is available. The color measurement data known from the "history" are preferably stored in memory and further developed with a view to the development expected for them, so that the aforementioned trend estimate is possible. The trend estimate is subjected to weighting in order to decide whether a correcting intervention should be made into the inking of the printing press. This corrective intervention can always be made whenever the color measurement data that are likely to be established for the future printing exceed a predeterminable tolerance.

Preferably, a linear trend estimate is made. Thus the already ascertained color measurement data are further developed in the sense of a linear trend estimate, preferably displayed in terms of a straight line; in the weighting, a check can be made as to whether the straight line, with its slope, exceeds or undershoots a predetermined tolerance threshold.

It is advantageous if in the trend estimate the future moment at which the trend estimate data exceed the tolerance is determined, and if the time period up to that moment is compared with a tolerance time period. The trend estimate is accordingly continued long enough into the future that its deviation from a nominal value of the color measurement data is so great that the predetermined tolerance is exceeded. The moment at which the exceeding takes place defines the aforementioned time period. This time period is compared with a tolerance time period, or in other words a predetermined variable. If the time period is shorter than the tolerance time period, then a corrective intervention into the inking is made by means of control or regulation that is either an open- or closed-loop control.

If the future time period is longer than the tolerance time period, then no correction of inking takes place.

It is advantageous if—as mentioned—a straight trend line is formed from the color measurement data originating in the known development over time, and if this line is provided with an extension which is the basis for the trend estimate, or forms this estimate.

Finally, it is advantageous if the straight trend line is developed from the weighted color measurement data of at least two time periods. Within the two periods of time, mean values can be calculated, so that two mean color measurement data are available at two different times, from which data the moment that the tolerance is exceeded can be calculated by means of a simple linear equation. In this way, it becomes unnecessary to perform a considerably more-complicated linear approximation.

Since the inking of a printing press, because the inking unit is embodied in zonal fashion, can be varied only zonally, only a single decision per zone is preferably reached as to whether, and if so in what way, the inking should be regulated or controlled. This decision is originally based—as shown—on the development of color measurement data over time. These color measurement data are preferably taken from a previously determinable color measurement field of the printed image. For that purpose, to attain the appropriate color measurement data, measurement must be done at at least one location within the ink zone for each zone to be regulated. It is possible now to provide only a single measurement location or a plurality of measurement locations within one ink zone. Per measurement location, in turn, a plurality of primary data values, for instance four color measurement data, may occur, namely and in particular one each for the X, Y and Z standard spectral values and one value for infrared. Since the printed image of each sheet is measured in particular, the method of the invention, because so little accrual of data occurs, offers the capability of fast and simple execution of inking control or regulation.

In accordance with the invention there is provided a method for controlling inking during the printing process, in particular during the production run, in a printing press, the printing press having an imaging device coupled to a computing device operative for collecting image color measurement data from the imaging device, and numerically processing the image data, and in which color measurement data are obtained from printed images produced on an continuous basis, these data being used for control or regulation to influence image inking if a predetermined image color tolerance is exceeded, which includes the steps of collecting of the image color measurement data over time, using the image color measurement data for computing a color trend estimate; weighting the color trend estimate and performing a corrective control of the inking if the color trend estimate data indicate that image coloring will move outside the allowable image color tolerance.

According to a further feature of the invention one of a linear or nonlinear color trend estimate is made.

According to still another feature, in computing the color trend estimate, if a future time period ($T_{+\sigma}$, $T-\sigma$) in which the color trend estimate exceeds the tolerance ($+\sigma$, $-\sigma$) is determined, comparing the time period ($T_{+\sigma}$, $T_{-\sigma}$) with a tolerance time period ($T_T$).

According to an additional feature, from the color measurement data, a straight trend line (g) is formed, and the trend line is extended with an extension (V), and the extension (V) is used as the basis for the trend estimate, and further still the straight trend line (g) is developed from weighted color measurement data ($M_1$, $M_2$) of two time periods ($Z_1$, $Z_2$).

Other features which are considered as characteristic for the invention are set forth in the appended claims.

Although the invention is illustrated and described herein as embodied in an method for adjusting the inking in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
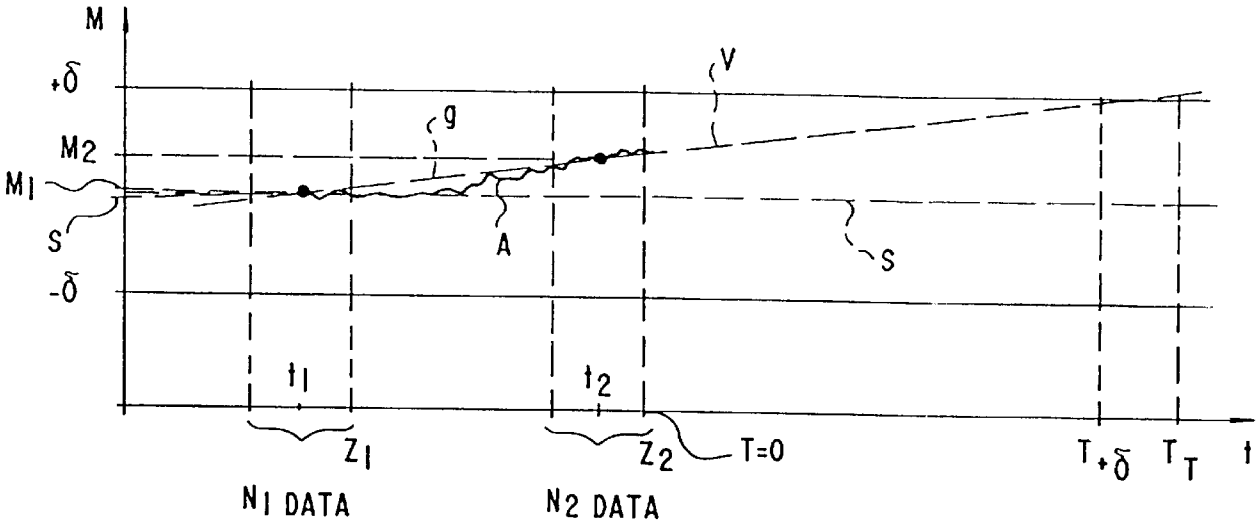
FIG. 1 shows a graph in which the color measurement data are plotted as a function of time.
Figure 3:
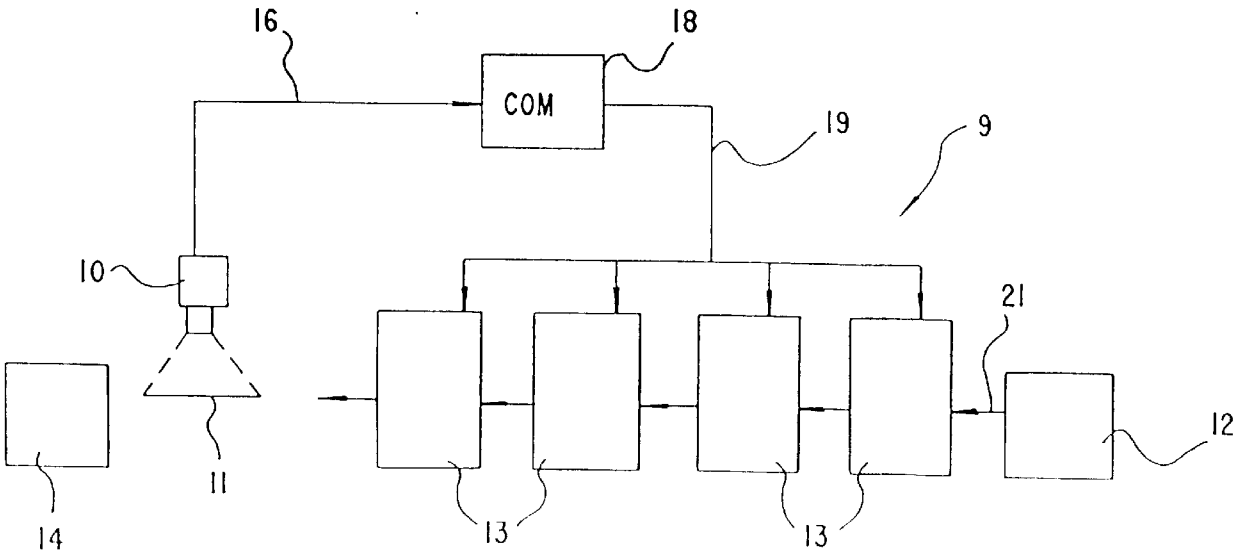
FIG. 3 is a block diagram of a printing machine adapted to perform the method of the invention.

In the method for controlling or regulating inking, which have open- or closed-loop control, during the printing process and in particular during a production run of a printing press, color measurement data M, shown as the ordinate axis in FIG. 1, are ascertained in the online mode by means of an optical detection device 10 (FIG. 3). At image points present in a preselectable number on each printed sheet of paper 1, the optical detection device 10 ascertains the color values in the form of color measurement values, by means of which the inking of the printing press can be varied by a controller for the ink feed. Below—for the sake of simplicity—the invention will be explained in terms of only a "one-dimensional" example. However, it is understood that these descriptions apply to multidimensional systems as well, that is, for a plurality of measurement locations within one or more ink zones, for instance; per measurement location, a plurality of color measurement data may be made, because of use of different printing inks and also infrared for black ink.

In FIG. 1, it is assumed that the number $N_1$ of color measurement data are collected in a first time range $Z_1$. In a later second time range $Z_2$, a number $N_2$ of color measurement data are collected. Both time ranges $Z_1$ and $Z_2$ are located in the past. The number of color measurement data collected in each time range by means of the optical detection device 10 can be selected beforehand; that is, within the two time ranges, and a suitable timewise classification can be made, wherein measurement and thus one collection of the data values occur at a given moment. Preferably, this is done for each sheet 11 of paper. Plotted on the ordinate are the values of the collected color measurement data M, and the nominal value is shown at S. In the graph, A is the current course of coloring, in the form of a curve. If within the first time range $Z_1$ a mean value of all the color measurement data M collected are formed, the result is for instance the mean value $M_1$ that are meant to be present at time $t_1$. The procedure is the same in the second time range $Z_2$, producing data of mean value $M_2$ at time $t_2$. The mean values $M_1$ and $M_2$ may preferably be sliding averages. If only a straight line is calculated, which passes through the two mean values $M_1$ and $M_2$, then the result is the straight trend g shown in FIG. 1, which passes through the two mean values $M_1$ and $M_2$ and with an extension V that sweeps over a period of time located in the future. It is assumed that the time T=0 on the abscissa shows the beginning time in performance of the method, so that all the actions occurring before the time T=0 are in the past, and the actions carried out after this time T=0 are part of the prediction. The rectilinear extension V of the straight line g means that—over the course of time—the deviation of the color measurement data M from the nominal value S becomes greater and greater based on this linear trend estimate, so that at a certain moment a deviation from the nominal value S exists that exceeds a predeterminable tolerance. This exceeding of the tolerance may occur with an ascending straight line g+σ or a descending straight line g−σ; in other words, the tolerance limits deviate from the nominal value S.

FIG. 1 shows that at a certain moment (or from a count of a certain number of sheets printed), the extension V of the straight trend line g intersects the tolerance (+σ). This is the moment $T_{+\sigma}$. Thus the linear trend estimate defines a time period between T=0 and $T_{+\sigma}$, which is compared with a predetermined tolerance time period $T_T$. If the time period $T_{+\sigma}$ is located within the tolerance time period $T_T$, then the color regulation is activated and influence is thus exerted on the inking of the printing press. If the moment $T_{+\sigma}$ were not located within the tolerance time period $T_T$, then no intervention into the color regulation would be made. The same is true accordingly if the tolerance −σ is exceeded. The tolerance time period $T_T$ is preferably determined by knowledge of the printing press dynamics or in other words the reaction time of the inking unit of the printing press. The following relationships apply to the variables of FIG. 1:

$$g = \frac{M_2 - M_1}{t_2 - t_1}$$

$$g = \frac{M - M_2}{t - t_2}$$

in which M and t represent arbitrary color measurement values and times, respectively.

$$T_{+6} = (S+ - M_2)\frac{t_2 - t_1}{M_2 - M_1} + t2$$

$$T_{-6} = (S- - M_2)\frac{t_2 - t_1}{t_2 - M_1} + t_2$$

$$M_1 = \frac{1}{N_1}\sum_1 M_t$$

$$M_2 = \frac{1}{N_2}\sum_2 M_t$$

Preferably, it is provided that the color measurement data of a measurement field are written continuously in a recirculating (ring) memory associated with the measurement field and are thus available for the further processing. A measurement field is understood to be a certain portion of a printed image; the printed image can preferably be understood as being subdivided into strips corresponding to the color zones, and imaginary dividing lines that separate individual fields, namely the aforementioned measurement fields, disposed crosswise to the strips.

The decision and in particular the zonal decision to regulate the inking naturally depends on the results of the trend estimate of all the color measurement locations in the corresponding zone. Preferably, various strategies are applicable: the color is regulated whenever a. only one measurement field requires this; or b. whenever the majority of measurement fields requires this; or c. only whenever all the measurement fields require this;

d. whenever at least one specially selected measurement location requires this.

The results of the trend estimates of the individual measurement locations and/or measurement fields can also be combined in weighted fashion in order in this way to arrive at a zonal decision.

Figure 2:
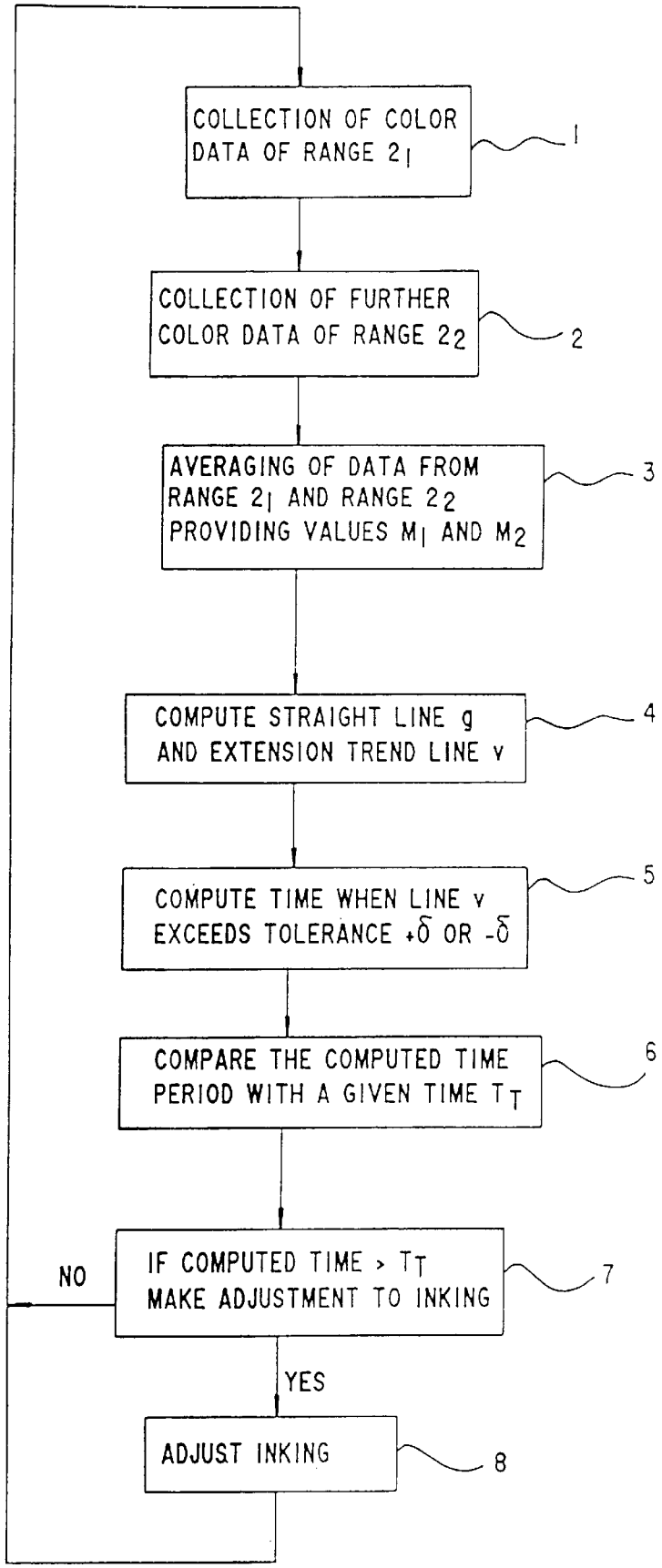
FIG. 2 is a flowchart of the method of the invention.

FIG. 2 shows a flowchart that illustrates the individual method steps. In step 1, within the first time range $Z_1$, color measurement data M are collected. In step 2, in the second time range $Z_2$, further color measurement data M are collected. In step 3, averaging of the color measurement data M within the first time range $Z_1$ and within the second time range $Z_2$ is done, producing mean values $M_1$ and $M_2$. In the next step 4, by means of a computer or the like, the straight line g is then calculated and the extension V of the straight line, on which the prediction is based, is formed. In the next step 5, the period of time within which the values of the linear trend estimate (extension V) exceed the predetermined tolerance $+\sigma$ or $-\sigma$ is then computed. In step 6, a comparison is made of the computed time period and a computed tolerance time period $T_T$. In step 7, depending on the aforementioned comparison, action is either exerted or not exerted on the inking of the printing press.

In FIG. 3 a typical printing machine 9 suitable for performing the disclosed is composed of four printing units 13, each printing one of the colors of which the printed image is formed. A web or sheets 11 to be printed issue from a feeder 12 and move through the machine as indicated by arrows 21, to a stacker or receiver 14. After leaving the last printing unit the image is scanned by an imaging device 10 of conventional construction. The imaging device 10 transmits on an output connection 16 electrical signals that represent the color image for all image regions of the image 11 to a computer 18. The computer performs the computations required for processing the image as described above and described in more detail in the flowchart of FIG. 2.

The computer 18 generates outputs on lead 19 which numerically represent the ink feed settings, i.e. the setting of a respective ink gap for each printing unit 13.

We claim:

1. A method for controlling inking during the printing process, in particular during the production run, in a printing press, the printing press having an imaging device coupled to a computing device operative for collecting image color measurement data from the imaging device, and numerically processing the image data, and in which color measurement data are obtained from printed images produced on an continuous basis, these data being used for control or regulation to influence image inking if a predetermined image color tolerance will be exceeded, which comprises the steps of collecting the image color measurement data over time, using the image color measurement data for computing a color trend estimate; evaluating the color trend estimate and performing a corrective control of the inking if the color trend estimate data indicate that image coloring will move outside the allowable image color tolerance; and wherein in computing the color trend estimate, if a future time period ($T_{+\sigma}$, $T_{-\sigma}$) in which the color trend estimate exceeds the tolerance ($+\sigma$, $-\sigma$) is determined, comparing the time period ($T_{+\sigma}$, $T_{-\sigma}$) with a tolerance time period ($T_T$).

2. The method of claim 1, which includes forming, from the color measurement data, a straight trend line (g), extending the trend line with an extension (V), and using the extension (V) as the basis for the trend estimate.

3. The method of claim 2, which includes developing the straight trend line (g) from evaluated color measurement data ($M_1$, $M_2$) of two time periods ($Z_1$, $Z_2$).

* * * * *